United States Patent [19]

Fuchs et al.

[11] Patent Number: 4,724,770

[45] Date of Patent: Feb. 16, 1988

[54] SUBCALIBER PROJECTILE WITH PIVOTALLY SEPARABLE DRIVE CAGE

[75] Inventors: Reinhart Fuchs, Unterhaching; Hans W. Luther, Kaarst; Peter Wallow, Duesseldorf; Jürgen Boecker, Oberhausen; Walter Simon, Aachen; Rudolf Romer, Kaarst; Klaus Gersbach, Willich; Bernhard Bisping, Ratingen; Karl W. Bethmann, Moers, all of Fed. Rep. of Germany

[73] Assignee: Rheinmetall GmbH, Duesseldorf, Fed. Rep. of Germany

[21] Appl. No.: 809,476

[22] Filed: Dec. 16, 1985

Related U.S. Application Data

[63] Continuation-in-part of Ser. No. 280,378, Jun. 22, 1981, abandoned.

[30] Foreign Application Priority Data

Jun. 26, 1980 [DE] Fed. Rep. of Germany ..... 3023980
Feb. 11, 1981 [DE] Fed. Rep. of Germany ..... 3104745

[51] Int. Cl.[4] ..... F42B 13/16
[52] U.S. Cl. ..... 102/521
[58] Field of Search ..... 102/520–523

[56] References Cited

U.S. PATENT DOCUMENTS 2,775,943 1/1957 Ekseigian ..... 102/523
2,996,011 8/1961 Dunlap ..... 102/521
3,620,167 11/1971 Romer et al. ..... 102/521
3,899,978 8/1975 Luther et al. ..... 102/521
4,362,107 12/1982 Romer et al. ..... 102/520

FOREIGN PATENT DOCUMENTS 754801 10/1970 Belgium ..... 102/703
1808779 6/1970 Fed. Rep. of Germany .

*Primary Examiner*—Harold J. Tudor

[57] ABSTRACT

A subcaliber projectile has a small-diameter projectile body extending along and centered on an axis, having a radially outwardly directed outer surface, and adapted to move in a predetermined axial back-to-front direction, and a sabot formed of a plurality of similar segments annularly surrounding at least a portion of the body, the segments forming an inner surface generally on the outer surface of the body and having an extreme front end and an extreme rear end. This projectile is formed on one of these surfaces at the extreme rear end of the sabot with a radially projecting ridge of generally semicircular shape having a center of curvature. The other of the surfaces is formed at the extreme rear end of each segment of the sabot with a radially open recess complementary to and receiving the ridge. In addition the segments are pivotal about the center of curvature without the ridge leaving the recess from a position with the respective inner surface lying on the outer projectile-body surface and a position with the inner surface projecting at an angle away therefrom.

11 Claims, 5 Drawing Figures

SUBCALIBER PROJECTILE WITH PIVOTALLY SEPARABLE DRIVE CAGE

CROSS REFERENCE TO RELATED APPLICATION

This application is a continuation-in-part of my patent application 280,378 filed June 22, 1981, now abandoned.

FIELD OF THE INVENTION

The present invention relates to a subcaliber projectile. More particularly this invention concerns such a projectile having a multipart drive cage or sabot.

BACKGROUND OF THE INVENTION

A standard subcaliber projectile has a projectile body normally of a relatively hard armor-piercing material and a drive cage or sabot surrounding this body. The projectile body is of a diameter or caliber substantially smaller than the barrel from which the projectile is fired, and the sabot is of substantially larger diameter and fits complementarily in the barrel of the gun from which the projectile is fired. The sabot serves to transmit the force of the propellant to the projectile body, and is constructed to separate from the body after leaving the muzzle so that the body presents substantially less air resistance. Thus a subcaliber projectile can be fired at extremely high muzzle velocities for good armor-piercing capacities and long range.

The separation of the sabot from the body must be uniform so that the body is not deflected from its intended trajectory. If, for instance, a piece of the sabot remains stuck to the body on the underside thereof after the remaining pieces of the sabot separate, the aerodynamics of the flight of the projectile body will be changed to cause it to fall short of its target. At the worst the projectile body can be set tumbling, making it largely ineffective.

In Belgian Pat. No. 754,801 the sabot is spool shaped and formed of two or three identical sector segments forming a cylindrical passage closely surrounding the projectile body and centered of course on the axis defined by this body. Somewhat ahead in the normal flight direction of the projectile of the extreme rear end of the sabot the projectile body is formed with a radially outwardly open semicircular-section groove in which complementary parts or formations of the sabot segments fit. This groove is provided as far forward on the projectile body as possible to prevent crushing of the projectile body, its function being to transmit axial forces from the propellant to the projectile body. On leaving the muzzle of the barrel the rings holding the sabot segments self-destruct, permitting these segments to separate radially outward. As soon as the radially inwardly projecting formations of the segments and the groove separate completely, the segments fall back away from the projectile body.

In U.S Pat. No. 2,775,943 of Eksergian the sabot is joined to the projectile body by engagement of a radially inwardly projecting ridge in a complementary outwardly open groove. Once again this arrangement uses radial separation of the sabot from the projectile. The interfitting groove and ridge are well forward of the rear end of the sabot so if the segments thereof are levered out with their front ends separating from the projectile body while their rear ends remain in contact therewith, as soon as the groove and ridge pull apart there will be axial sliding and general disengagement.

As a result this system, like that of the above-discussed Belgian patent, will not ensure rapid and even separation of the sabot segments from the projectile body, and in fact will allow them to slide back on it once they are separated. Thus lateral deflection of the projectile body by the separating sabot is likely.

Similarly, U.S. Pat. Nos. 3,620,167 and 4,362,107 both of Romer have arrangements wherein the front part of the sabot is axially forwardly and radially inwardly concave to act as an air scoop so that trapped air drives the front ends of the sabot segments radially outward. In this arrangement the sabot segments are adhered to a sealing disk that is fixed to the projectile, so that once again these sabot segments can relatively easily interfere with the projectile body during separation and deflect it from its trajectory.

OBJECTS OF THE INVENTION

It is therefore an object of the present invention to provide an improved subcaliber projectile.

Another object is the provision of such a subcaliber projectile which overcomes the above-given disadvantages, that is whose sabot separates evenly and surely from the projectile body without interfering with its trajectory at all.

A further object is to further the principles and ideas of the parent application, and in particular to provide excellent force transmission between the sabot and the projectile body during firing and accurate separation after leaving the muzzle.

SUMMARY OF THE INVENTION

A subcaliber projectile has a small-diameter projectile body extending along and centered on an axis, having a radially outwardly directed outer surface, and adapted to move in a predetermined axial back-to-front direction, and a sabot formed of a plurality of similar segments annularly surrounding at least a portion of the body, the segments forming an inner surface generally on the outer surface of the body and having an extreme front end and an extreme rear end. This projectile is formed according to this invention on one of these surfaces at the extreme rear end of the sabot with a radially projecting ridge of generally semicircular shape having a center of curvature. The other of the surfaces is formed at the extreme rear end of each segment of the sabot with a radially open recess complementary to and receiving the ridge. In addition the segments are pivotal about the center of curvature without the ridge leaving the recess from a position with the respective inner surface lying on the outer projectile-body surface and a position with the inner surface projecting at an angle away therefrom.

The segments can each be formed with a bump and the bumps together can form the ridge. Similarly, the recess can have a plurality of discrete sections respectively receiving the bumps of the segments. In such case each recess can be formed as a part-cylindrical groove centered on an axis extending chordally of the projectile body in a plane perpendicular to the axis thereof.

With such an arrangement the sabot segments separate from the projectile body in an accurately controlled and extremely uniform manner. Thus they will not deflect the projectile from its desired trajectory.

According to another feature of this invention the outer surface of the projectile is formed at each of the segments with a radial projection having a front surface forming an obtuse angle with the axis and an arcuate rear surface having a center of curvature lying generally at the center of curvature of the ridge. In addition the inner surface of each segment is formed with a pocket receiving the respective projection and having an arcuate rear surface complementary to that of the respective projection. Thus on pivoting of the segments on the ridge the rear surfaces of the pockets remain in axial contact with the rear surfaces during the initial pivoting of the segments about the center of curvature. Such construction ensures extremely good force transmission from the segments to the projectile body during firing, and extremely accurate and regular separation after leaving the muzzle.

According to further features of this invention the rear surfaces remain in contact with each other during at least the first 30° of pivoting of the segments about the center of curvature. The obtuse angle of the front surfaces is similarly great enough to ensure separation with interference.

Normally the the ridge and projection are fixed to the projectile body. They may be unitary with a belt carried on the projectile body.

In accordance with further features of this invention the ridge and projection are made of a material of lower density, lower fusion point, and greater affinity for oxygen than the projectile body. This material can be a multiphase material, can have at least one metalloid phase, can be at least partially a synthetic resin, or at least partially magnesium. The material can be partially of a mineral, such as hollow glass spheres.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
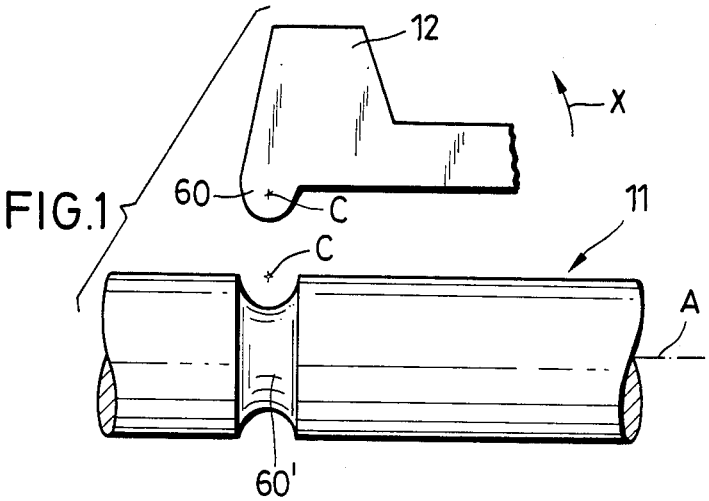
FIG. 1 is a side view of a center part of a projectile according to this invention.

As seen in FIG. 1 a subcaliber projectile according to this invention has a plurality of identical sabot-forming segments 12 and a cylindrical projectile body 11 centered on a projectile axis A. The segments 12 are formed at their extreme rear ends with radially inwardly projecting semicircular-section bumps 60 that together form a discontinuous radially inwardly projecting ridge and the body 11 is formed with a complementary radially outwardly open semicircular-section groove or recess 60'. In use the bumps 60 fit snugly in the groove 60' with the centers of curvature C of these formations coinciding. Thus, after leaving the muzzle of the barrel from which the projectile 11, 12 is fired, the segments 12 pivot back as indicated by arrow X, rocking about the centers C. Such action ensures rapid and regular separation of these segments 12 so that the trajectory of the projectile body 11 is not disturbed.

Figure 3:
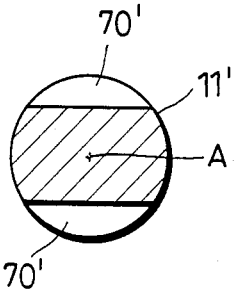
FIG. 3 is a section taken along line III—III through the projectile body of FIG. 2.
Figure 2:
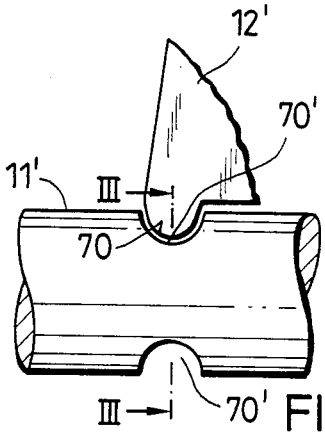
FIG. 2 is a side view of a second system according to this invention.

In FIGS. 2 and 3 a similar system is used, but here two segments 12', of which only one is shown, are used. These segments 12' have semicylindrical bumps 70 and the projectile body 11' is formed with a pair of grooves or recesses 70' of complementary semicylindrical shape, centered on respective axes extending chordally of the cylindrical projectile body 11' and in a plane perpendicular to its axis A. Thus in this arrangement the two sabot segments 12' will pivot out diametrically oppositely. The considerable surface contact afforded by the semicylindrical shape of the bumps 70 and recesses 70' gives good force transmission during firing and good separation control after firing.

Figure 4:
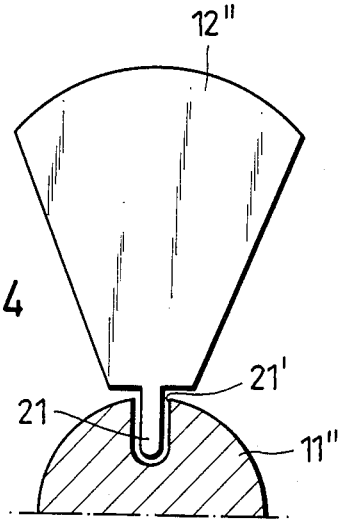
FIG. 4 is a cross section through a third projectile according to this invention.

In a variation on the system of FIGS. 2 and 3 as shown in FIG. 4, the segments 12', which can number six, have short semicylindrical tabs or projections 21 that fit in complementary angularly delimited pockets 21' of the projectile body 11''. The fit of the tab 21 in the pocket 21' ensures excellent guiding of the sabot segment 12'' as it separates from the projectile body 11'' so that it will not interfere with its flight.

Figure 5:
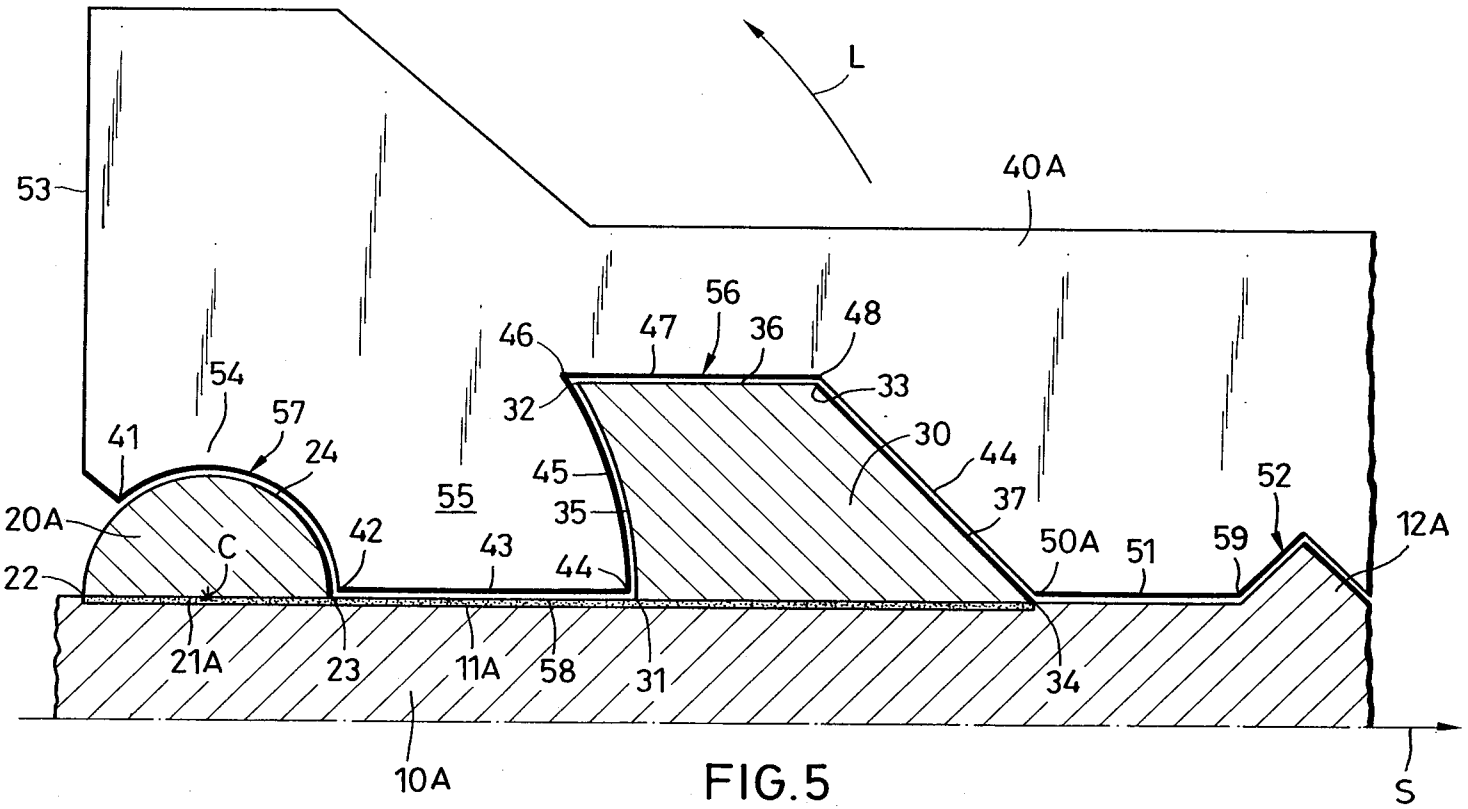
FIG. 5 is an axial section through a fourth arrangement in accordance with the present invention.

FIG. 5 shows yet another arrangement. Here a single sabot segment 40A is shown on a projectile body 10A, although it is of course still understood that a plurality of such segments forming an annular collar or sleeve are provided. A cylindrical belt 21A is adhesively adhered to the outer surface 11A of this body 10A and carries at its rear end a single continuous semicircular-section ridge 20A and at its front end a plurality of guide projections 30, one for each of the segments 40A. In addition the body 10A is formed ahead of the belt 21A with a radially outwardly projecting ridge **12*a***.

The segments 40A have extreme rear ends 54 with rear end surfaces 53 and are each formed at this end 54 with a part-circular-section pocket 57 complementary to the outer surface 24 of the ridge 20A. This pocket or recess 57 has a front end 42 normally at the front edge 23 of the ridge 20A and a rear edge 41 located some 30° to 35° up from the rear edge 22 of the bump 20A, relative to the center of curvature C of both of these formations 57 and 24. This edge 41 extends as a radius from the respective center C.

At the respective projection 30 each segment 40A is formed with a radially inwardly open pocket 56 perfectly complementary to the respective projection 30. Thus each pocket 56 has a front edge 50A normally at the front edge 34 of the projection 34, a front surface 44 extending in a straight line back along the front edge 37 of the projection 30 to respective front corners 48 and 33, a surface 47 extending in a straight line along the surface 36 parallel to the axis S of the body 10A and terminating at respective rear corners 46 and 32, and a rear surface 45 extending arcuately along the rear surface 35 of the projection 30 and terminating at respective corners 31 and 44. The surfaces 35 and 45 are circularly arcuate and centered on the respective centers C of curvature of the surfaces 57 and 24. Between each pocket 56 and each recess 57 the segment 40A has a tab 55 defining a flat surface 43 resting o the complementary surface 58 of the body 10A. Forward of each pocket 56 each segment 40A has a surface 51 lying flatly on the body 10A and having a front edge 59 at which a triangular-section pocket 52 is formed for the ridge 12A.

This system is extremely advantageous in that it ensures excellent force-transmitting contact between the segments 40A and the body 10A. Axially forwardly effective thrust exerted on the rear surface 53 from the back to the front, that is from the left to the right as seen in FIG. 5, will in effect wedge the tab 55 under the projection 30, causing the sabot segment 40A to transmit this force very efficiently to the projectile body 10A. Any possibility of separation of the sabot formed by the segments 40A and the body 10A is therefore impossible. In fact the thrust at the rear end will have a radially inwardly directed component or vector that will hold the segments 40A even more tightly on the body 10A.

Once the projectile leaves the muzzle of the barrel from which it is fired, the scoop effect at the front end, which is shaped in the manner described in the above-cited Romer patents, will pivot the sabot segments 40A out. They will move evenly and smoothly as indicated by arrow L, with the surface 57 sliding in surface contact on the surface 24 and the surfaces 35 and 45 similarly sliding on one another. After pivoting through 30° to 35° the rear edge 41 of the surface 57 will come to the rear edge 22 of the surface 24 and similarly the edge 44 of the surface 45 will pass the edge 32 of the surface 35, whereupon the segment 40A will separate smoothly and cleanly from the projectile body 10A.

The belt 21A, ridge 20A, and projection 30 are all integral and can even be unitary. They are formed of a material which is much lighter than the hard armor-piercing steel alloy of the body 10A, and which also is likely to melt and/or oxidize rapidly so that after the sabot segments 40A are gone they quickly melt and/or burn off, leaving the cylindrical outer surface of the projectile fairly unencumbered.

We claim:

1. In a subcaliber projectile having a small-diameter projectile body extending along and centered on an axis, having a radially outwardly directed outer surface, and adapted to move in a predetermined axial back-to-front direction; and a sabot formed of a plurality of similar segments annularly surrounding at least a portion of the body, the segments forming an inner surface generally on the outer surface of the body and having an extreme front end and an extreme rear end, the improvement wherein the outer surface is formed at the extreme rear end of the sabot with a radially outwardly projecting ridge of generally semicircular shape having a center of curvature;

the inner surface is formed at the extreme rear end of the sabot with a radially inwardly open recess complementary to and receiving the ridge;

the segments are pivotal about the center of curvature without the ridge leaving the recess from a position with the respective inner surface lying on the outer projectile-body surface and a position with the inner surface projecting at an angle away therefrom;

the outer surface is formed at each of the segment with a radial projection having a front surface forming an obtuse angle with the axis and an arcuate rear surface having a center of curvature lying generally at the center of curvature of the ridge; and the inner surface of each segment is formed with a pocket receiving the respective projection and having an arcuate rear surface complementary to that of the respective projection, whereby on pivoting of the segments on the ridge the rear surfaces of the pockets remain in axial contact with the rear surfaces during the initial pivoting of the segments about the center of curvature.

2. The subcaliber projectile defined in claim 1 wherein the rear surfaces remain in contact with each other during at least the first 30° of pivoting of the segments about the center of curvature.

3. The subcaliber projectile defined in claim 1 wherein the ridge and projection are fixed to the projectile body.

4. The subcaliber projectile defined in claim 3 wherein the ridge and projection are made of a material of lower density, lower fusion point, and greater affinity for oxygen than the projectile body.

5. The subcaliber projectile defined in claim 4 wherein the material is a multiphase material.

6. The subcaliber projectile defined in claim 5 wherein the material has at least one metalloid phase.

7. The subcaliber projectile defined in claim 5 wherein the material is at least partially a synthetic resin.

8. The subcaliber projectile defined in claim 5 wherein the material is at least partially magnesium.

9. The subcaliber projectile defined in claim 5 wherein the material is at least partially of a mineral.

10. The subcaliber projectile defined in claim 9 wherein the mineral is hollow glass spheres.

11. The subcaliber projectile defined in claim 1, further comprising a belt surrounding and fixed to the projectile body at the ridge and projections and integral with the ridge and projections.

* * * * *